US005257526A

United States Patent [19]

Teixeria

[11] Patent Number: 5,257,526

[45] Date of Patent: Nov. 2, 1993

[54] AUTOMOTIVE FRAME STRAIGHTENING APPARATUS

[76] Inventor: Louis Teixeria, 62 Laura Keene Ave., Acushnet, Mass. 02743

[21] Appl. No.: 9,335

[22] Filed: Jan. 26, 1993

Related U.S. Application Data

[63] Continuation of Ser. No. 782,982, Oct. 28, 1991, abandoned.

[51] Int. Cl.[5] ..... B21D 1/12

[52] U.S. Cl. ..... 72/457; 72/705

[58] Field of Search ..... 72/447, 457, 705

[56] References Cited

U.S. PATENT DOCUMENTS

| | | | |
|---|---|---|---|
| 2,512,228 | 6/1950 | Fontaine | 72/705 |
| 2,717,020 | 9/1955 | Dobias | 72/705 |
| 3,340,720 | 9/1967 | Chartier | 72/705 |
| 3,518,867 | 7/1970 | Rouis | 72/389 |
| 3,556,482 | 1/1971 | Whitney | 254/134 |
| 3,625,047 | 12/1971 | Lunardini | 72/705 |
| 3,776,019 | 12/1973 | Shaw | 72/404 |
| 3,835,692 | 9/1974 | Hoffman | 72/705 |
| 3,927,550 | 12/1975 | Samuelsson | 72/705 |
| 3,999,419 | 12/1976 | Larson et al. | 72/457 |
| 4,050,287 | 9/1977 | Borup | 72/457 |
| 4,248,079 | 2/1981 | Specktor | 72/465 |
| 4,296,626 | 10/1981 | Jarman et al. | 72/392 |
| 4,313,335 | 2/1982 | Eck | 72/457 |
| 4,643,015 | 2/1987 | Larson et al. | 72/705 |
| 4,932,236 | 6/1990 | Hinson | 72/705 |
| 5,036,695 | 8/1991 | Bergeron | 72/705 |

*Primary Examiner*—Lowell A. Larson

*Attorney, Agent, or Firm*—Salter, Michaelson & Benson

[57] ABSTRACT

Apparatus is disclosed for straightening the frame of a damaged vehicle and includes a bed on which the damaged vehicle is located during the frame straightening operation. A plurality of towers are mounted on the bed and are adjustably movable in a horizontal direction relative thereto. Some of the primary towers include a pushing and holding mechanism, and a pulling mechanism; while other towers include only a pushing and holding mechanism. The pushing and holding mechanism of a tower is operable to selectively push or hold a designated location of the damaged vehicle frame, and is simultaneously selectively operable with a pushing and holding mechanism and/or the pulling mechanism of towers as applied to a separate designated location of the vehicle frame to effectively straighten the frame of the vehicle.

3 Claims, 5 Drawing Sheets

AUTOMOTIVE FRAME STRAIGHTENING APPARATUS

This is a continuation of application Ser. No. 07/782,982 filed Oct. 28, 1991, now abandoned.

BACKGROUND OF THE INVENTION

The present invention relates to apparatus for straightening the frame of a damaged vehicle. More particularly, the frame straightening apparatus of the subject invention incorporates primary and secondary towers that selectively push or pull the frame and simultaneously hold the frame at selected locations to effectively straighten the frame of the vehicle of critical importance is the reduction of the time required for carrying out the frame straightening operation by the subject invention as compared with prior known apparatus.

Prior to the instant invention various kinds of vehicle frame straightening equipment have been developed, most of which incorporate pulling devices, for purposes of straightening the frame of a Vehicle. Some examples of the apparatus that have incorporated different kinds of mechanisms for carrying out a frame straightening operation are illustrated in the U.S. Pat. No. 3,518,867 to Rouis; Whitney U.S. Pat. No. 3,556,482; Larson et al U.S. Pat. No. 3,999,419; Borup U.S. Pat. No. 4,050,287; Specktor U.S. Pat. No. 4,248,079; Jarman et al U.S. Pat. No. 4,296,626; and Eck U.S. Pat. No. 4,313,335.

As will be noted in the above referred-to U.S. Patents, apparatus for straightening vehicle frames have incorporated pulling devices which include a chain having a hook attached to the outermost end thereof that is normally secured to a selected portion of the frame on which a pulling action is exerted. Such pulling chains are normally operatively interconnected to a piston of a hydraulic cylinder which upon actuation exerts the necessary pulling force for carrying out the frame straightening operation. Examples of this type of equipment are illustrated in the U.S. Pat. No. 4,296,626 to Jarman et al, and Eck U.S. Pat. No. 4,313, 335. Other apparatus utilize beams that are movable to exert a pulling action through a chain or the like for straightening the vehicle frame and such equipment is illustrated in the U.S. Pat. No. 3,556,482 to Whitney, and Larson et al U.S. Pat. No. 3,999,419. The other patents referred to above also show various kinds of pulling devices that are generally designed to exert a pulling action on a selected portion of a frame for carrying out the frame straightening operation.

In all of the referred to patents as indicated hereinabove, the vehicle must be secured in place and this has been usually accomplished by attaching a series of chains to the vehicle frame and to a fixed frame location. Conventional pinch weld clamps are also commonly used in unitized frames to hold the vehicle frame in a fixed position. In the prior known apparatus the straightening operation was generally accomplished by exerting a pulling action on the frame that was created by the use of the chains which as described were interconnected to pistons of hydraulic cylinders or the like. It is significant that in all of the patents as referred to herein, none of them effectively carry out the frame straightening operation without considerable set-up time which requires a great deal of effort on the part of the users of the equipment; and it is not uncommon for a frame straightening machine to require several hours of set-up time and several more hours to carry out the frame straightening operation. This considerable expenditure of time in setting up and carrying out the frame straightening operation substantially increased the cost of the procedure for the owner of the equipment, and the equipment is not only difficult for the user to operate effectively, but further results in unreasonably high costs to the owner of the vehicle.

As will be set forth hereinafter, the frame straightening apparatus of the subject invention reduces the set-up time for placing the equipment in proper location and for more effectively carrying out the frame straightening operation, all to the benefit of the owner of the vehicle in that costs for the straightening operation are effectively reduced.

SUMMARY OF THE INVENTION

The present invention relates to apparatus for straightening the frame of a damaged vehicle and comprises a bed on which the damaged vehicle is located during the frame straightening operation. A plurality of towers are mounted on the bed and are adjustably movable in a horizontal direction relative thereto, but are disposed in a fixed position during the use thereof. In actual operation two or more of the primary towers are normally employed in the operation of the apparatus. The towers include at least a pushing and holding mechanism in the form of a hydraulic ram, and in some instances include a pulling mechanism which includes a chain which is operatively interconnected to the piston of a hydraulic cylinder. The pushing and holding mechanism of the towers is operable to selectively push or hold a designated location of the damaged vehicle frame, and is simultaneously selectively operable with a pulling mechanism that is applied to another specific designated location of the vehicle frame whereby the frame of the vehicle is effectively straightened upon operation of the hydraulic mechanisms as mounted on the towers.

Accordingly, it is an object of the present invention to provide a frame straightening apparatus that incorporates a plurality of towers on which pushing, holding, and pulling mechanisms are operably mounted, the pushing, holding, and pulling mechanisms being simultaneously and selectively operable as applied to separate designated locations of the vehicle frame to effectively straighten the frame of the vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIGS. 4*a* through 9*a* are diagrammatic illustrations corresponding to FIGS. 4 through 9, and that show the manner in which the subject invention provides for the straightening of the misaligned damaged frames as illustrated.

DESCRIPTION OF THE PREFERRED EMBODIMENT

Figure 1:
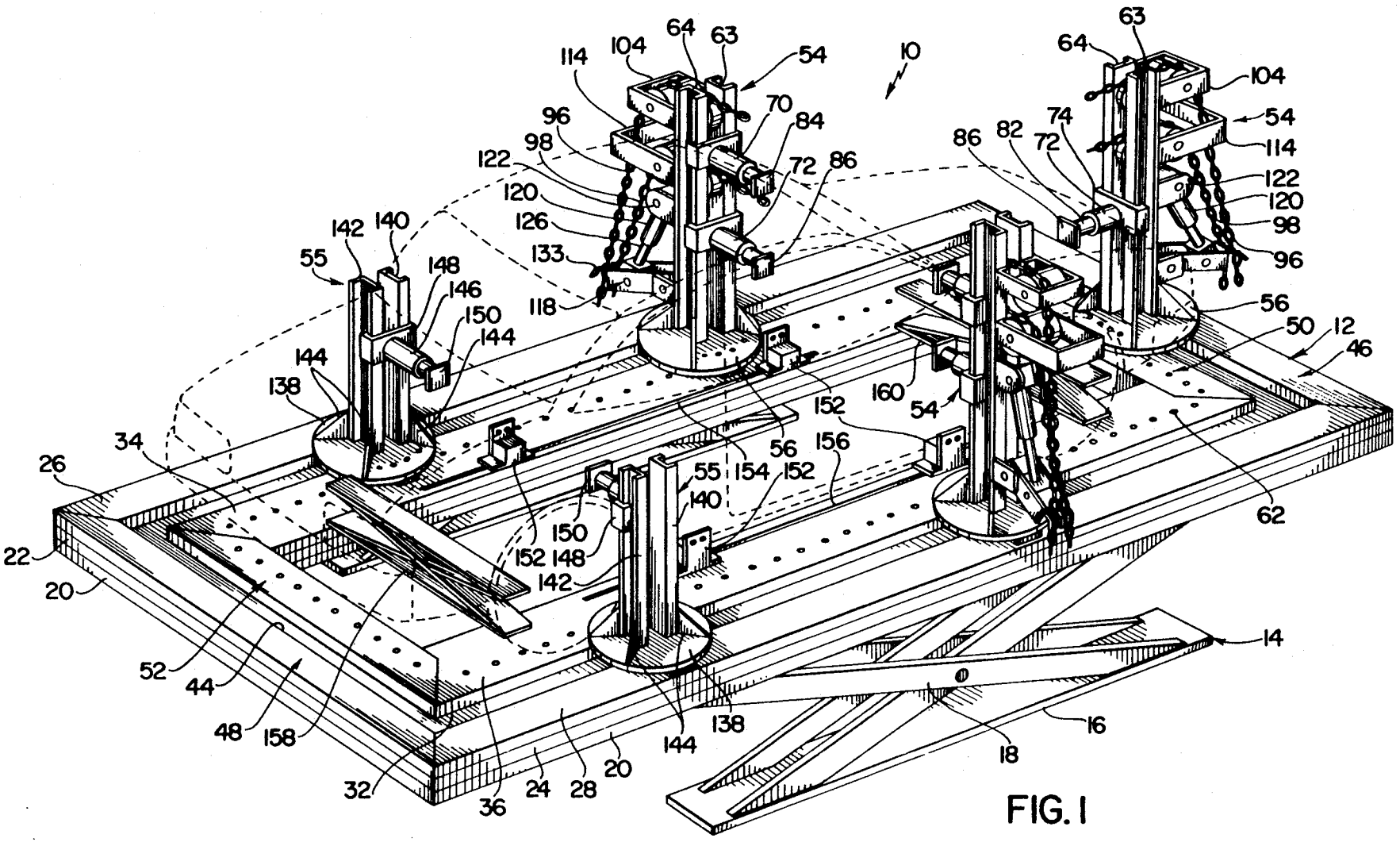
FIG. 1 is a perspective view of the frame straightening apparatus as embodied in the subject invention.

Referring now to the drawings, and particularly to FIG. 1, the frame straightening apparatus as embodied in the subject invention is illustrated and is generally indicated at 10. The frame straightening apparatus 10 includes a bed generally indicated at 12 that is supported by a lifting mechanism generally indicated at 14 that is comprised of a base 16 and a scissors structure 18 that is operated by a hydraulic ram (not shown) that lifts the bed 12 to a desired elevation.

Figure 2:
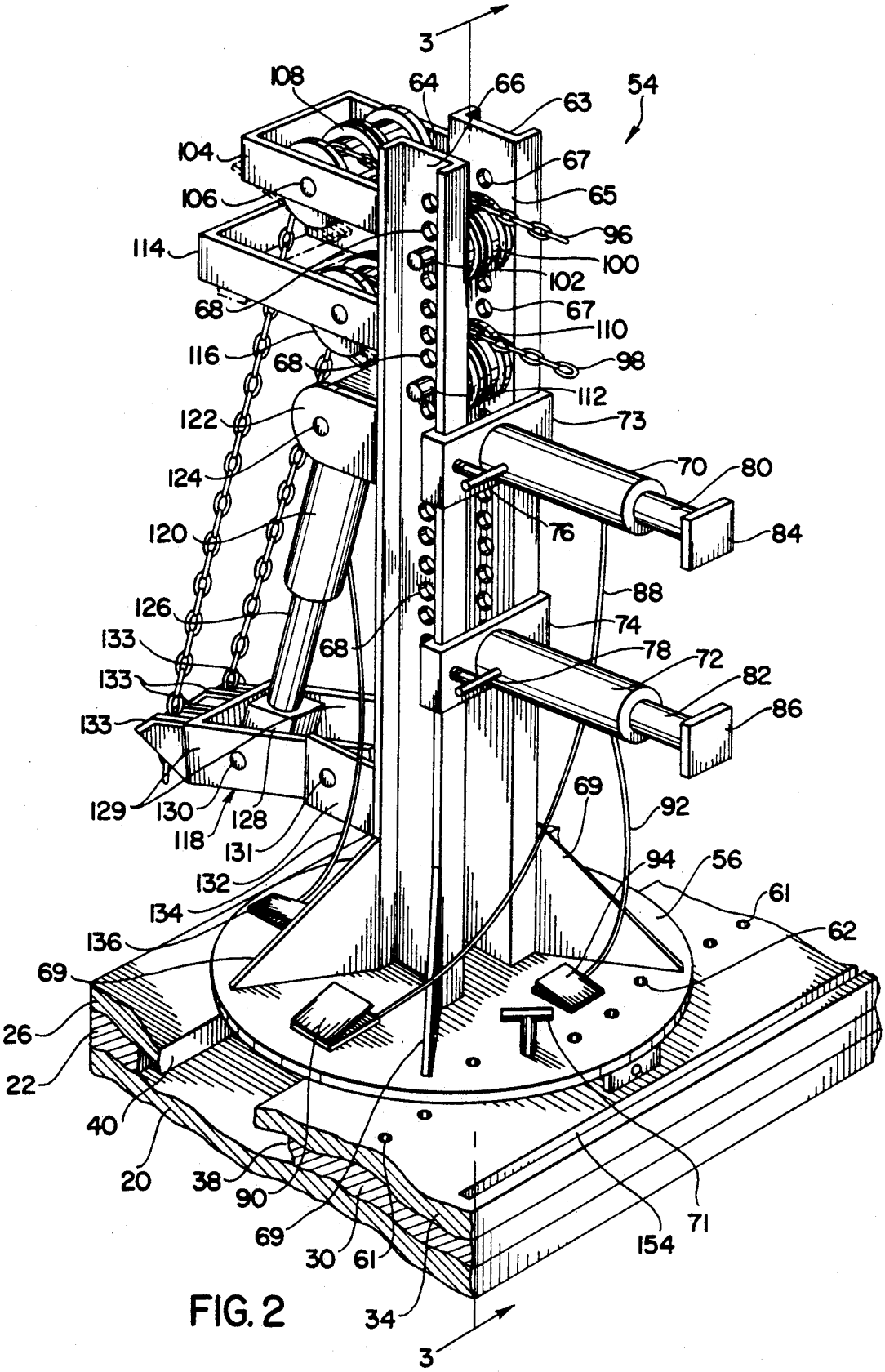
FIG. 2 is an enlarged perspective view of a primary tower as mounted on the bed of the frame straightening apparatus shown in FIG. 1, the bed being shown in partial sectional and perspective view.
Figure 3:
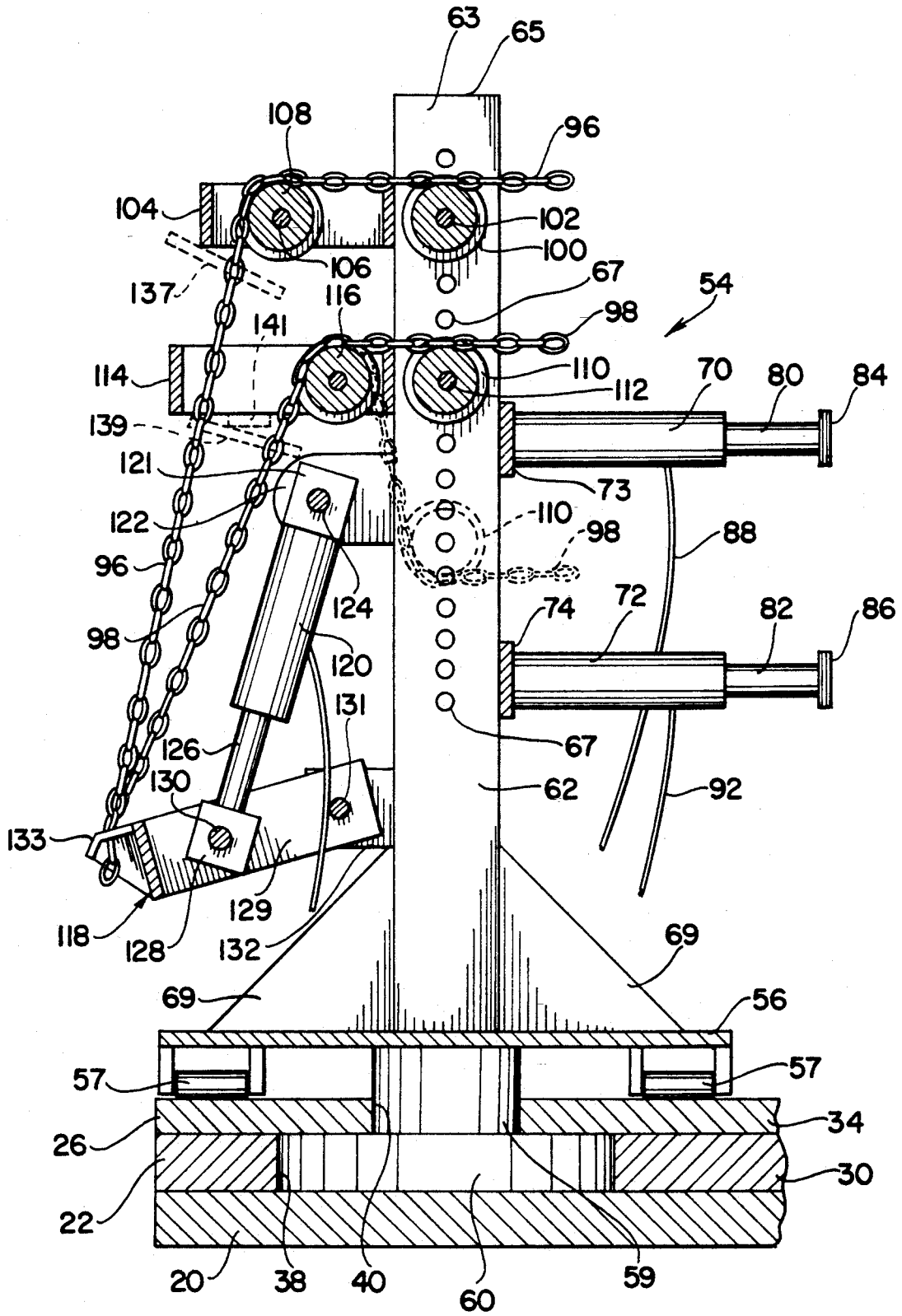
FIG. 3 is a sectional view taken along lines 3—3 in FIG. 2.

As shown in FIGS. 1 through 3, the bed 12 includes a flat rectangularly shaped base member 20 on which spaced intermediate outer longitudinal frame members 22 and 24 are mounted. Located on the spaced intermediate outer frame members 22 and 24 are spaced upper outside frame members 26 and 28, respectively. Located interiorly of the spaced intermediate outer frame members 22 and 24 in spaced parallel relation therewith are intermediate inner frame members 30 and 32, upper inner frame members 34 and 36 being mounted on the intermediate inner frame members 30 and 32. The intermediate members 22 and 30 are spaced apart to define a longitudinally extending slot 38 that cooperates with a space 40 defined between the upper frame members 26 and 34 to form a "T" shaped groove. The outer and inner frame members 24 and 32, and upper outside frame member 28, and upper inner frame member 36 also cooperate to form a "T" shaped groove o the opposite side of the bed. Similar "T" shaped grooves 42 and 44 are formed at the ends of the bed 12 by outer lateral frame assemblies generally indicated at 46 and 48, and inner lateral frame members generally indicated at 50 and 52, the grooves 42 and 44 communicating with the "T" shaped grooves as formed between the longitudinally extending frame members as described above. As will be described, the "T" shaped grooves as formed between the longitudinally and laterally extending frame members of the bed 12 provide for adjustable sliding movement of the tower members that enable the frame straightening operation to be carried out both effectively and efficiently.

As further shown in FIG. 1, the base member 20, the interior frame members 34 and 36, and the corresponding interior end frame members 50 and 52 are located such as to define a bed interior space or opening therebetween that provides for exposing the underside of the vehicle when it is mounted on the bed 12. This interior space also enables technicians to have access to the underside of the vehicle, if necessary, when the bed is elevated to an upper position by the scissors lifting mechanism 14. The upper interior frame members 34 and 36 are also appropriately spaced apart for receiving the wheels of the vehicle thereon (as shown in phantom in FIG. 1), when the vehicle is mounted in position on the bed 12.

In order to straighten the damaged frame of a vehicle that is mounted on the bed 12, a plurality of towers are provided, primary towers being generally indicated at 54, and secondary towers being generally indicated at 55. As will be apparent from the following description, the primary towers 54 are provided with means for holding the vehicle frame in a fixed position, or for exerting a pushing action thereon, and are further provided with pulling means that cooperate with the holding and pushing means in carrying out the frame straightening operation. As will be described, the secondary towers 55 are normally provided with holding or pushing means, and are also employed as holding devices for the damaged frame during the frame straightening operation.

Referring again to FIGS. 2 and 3, one of the primary towers 54 is illustrated in detail and includes a circular base plate 56. Joined to the underside of the base plate 56 are roller assemblies 57 that engage the spaced upper inner and outer frame members 26 and 34, for example, to provide for sliding movement of the towers 54 thereon. Secured to the underside of the base plate 56 is a shaft 59 to which a circular guide plate 60 is fixed. The shaft 59 extends through the space 40, the guide plate 60 being received on the base member 20 for sliding and rotating movement thereon. It is also seen that the towers 54 are mounted on the bed in such a manner as to effectively withstand the high bending forces applied thereto during a frame straightening operation. As shown more clearly in FIG. 2, the upper inner frame member 34, for example, is provided with a plurality of spaced holes 61, and the base plate 56 of the tower 54 is provided with spaced holes 62 that are disposed in an arcuate formation thereon. The primary tower member 54 is slidably and rotatably moved to a desired position and is then fixed in place by a lock pin 71 that extends through an appropriate hole 62 in the base plate 56 and is received in a hole 61 in the upper inner frame member 34.

Mounted in vertical relation on the base plate 56 are spaced beams 63 and 64 that are held in fixed relation on the base plate 56 by a plurality of web plates 69 that are welded to the beams 63 and 64 and to the base plate 56. The beams 63 and 64 are formed in a "C" configuration, the legs of the beams facing away from each other such that the longitudinally extending faces 65 and 66 of the beams are disposed in spaced parallel relation. Formed in the faces 65 and 66 are a plurality of spaced openings 67 and 68, respectively, that are disposed in vertically spaced and aligned relation therein and that provide for the mounting of certain components on the beams, as will be hereinafter described.

One of the functions of the primary tower 54 is to retain the damaged vehicle frame in a fixed position during the frame straightening operation. In order to carry out this function, spaced hydraulic cylinders 70 and 72 are provided and are mounted on the beams 63 and 64. For this purpose the hydraulic cylinders 70 and 72 have mounting brackets 73 and 74, respectively, secured to the inner ends thereof, the mounting brackets 73 and 74 being slidably engageable with adjacent legs of the beams 63 and 64, and being held in place by means of set screws 76 and 78, respectively. It is seen that the hydraulic cylinders 70 and 72 can be vertically adjusted on the beams 63 and 64 to locate the cylinders 70 and 72 in any desired vertical position thereon. Received within the cylinders 70 and 72 are pistons 80 and 82, respectively, on the outermost ends of which holding plates 84 and 86 are secured. The holding plates 84 and 86 are designed to be engageable with a selected area of the vehicle frame to be straightened, and as will be described can either exert a holding or pushing action thereon as required. Interconnected to the cylinder 70 is a hydraulic line 88 that is received in a control member 90, the control member 90 being shown as a foot pedal that selectively controls the axial movement of the piston 80 in the operation of the cylinder 70. It is also contemplated that the control member 90 be a hand controlled device of any suitable construction and operation. An hydraulic line 92 interconnects the hydraulic cylinder 72 and a suitable foot pedal control 94, the piston 82 being controllably moved in an axial direction during the frame straightening operation to place the holding plate 86 in contact with a selected portion of the damaged vehicle frame for holding or exerting a pushing action thereon.

In the frame straightening operation, it is usually necessary to exert a pulling action on selected areas of the damaged frame, and for this purpose pulling chains 96 and 98 are mounted on the primary tower 54. Each of the pulling chains 96 and 98 normally include a hook member (not shown) that is secured to the outer end thereof, the chain 96 extending over one portion of a double pulley construction 100 that includes independently movable pulley units that are mounted on coaxial stub shafts one of which is indicated at 102 and that are received in appropriate openings 67 and 68 of the beams 63 and 64, respectively. Secured to the beams 63 and 64 and extending rearwardly therefrom, is an upper U-shaped bracket 104 in which dual stub shafts one of which is indicated at 106 are mounted for receiving a double pulley construction 108 in rotating movement thereon. The chain 96 extends over one member of the double pulleys 108 as illustrated in FIGS. 2 and 3. It is understood that additional chains may be received over the double pulley constructions 100 and 108 if additional pulling action is required.

Mounted below the pulley 100 between the spaced beams 63 and 64 is a double pulley construction 110 that is rotatably located between the beams on dual stub shafts one of which is indicated at 112 that are received within appropriate openings 67 and 68 as formed in the faces 65 and 66 of the beams 63 and 64, respectively. Located adjacent to the pulley 110 is an intermediate U-shaped bracket 114 in which a double pulley construction 116 is mounted. The chain 98 extends over one of the pulley members of the double pulley 110 and the double pulley 116 for securement with the chain 96 to a lower bracket generally indicated at 118, as will be described. As further illustrated in FIG. 3, the vertical location of the pulling chain 98 can be adjusted by vertically adjusting the position of the appropriate pulley of the double pulley 110 between the beams 63 and 64. As indicated in phantom in FIG. 3, the double pulley 110 has been moved downwardly between the beams 63 and 64 to a lower position to enable the chain 98 to be received on the underside of the pulley member of the double pulley 110 during the frame straightening operation. The location of the pulling chain 98 will, of course, be determined by the nature of the damage to the frame to be straightened and the attachment of the pulling chain to the frame in connection therewith. In the frame straightening operation the pulling chains 96 and 98 are operatively urged in a pulling direction by means of a hydraulic cylinder 120, that is pivotally mounted between spaced plates 122 that are secured to the beams 63 and 64. A pin 124 extends through an upper block 121 attached to the cylinder 120 and is secured between the plates 122 for mounting the hydraulic cylinder 120 in pivotal relation. Axially movable in the cylinder 120 is a piston 126, having a lower block 128 located on the lowermost end thereof. The lower block 128 is pivotally mounted between opposed plates 129 on a pin 130 in the lower bracket 118. The lower bracket 118 is also pivotally mounted on the beams 63 and 64 through a pin 131 that is pivotally located between connecting plates 132 that are fixed to the beams. Extending outwardly of the lower bracket 118 are spaced fingers 133 between which the lowermost ends of the pulling chains 96 and 98 are secured. An hydraulic line 134 extends between the hydraulic cylinder 120 and a foot pedal control 136, the pedal control 136 providing for movement of the piston 126, as required. Thus, in the operation of the hydraulic cylinder 120 the bracket 118 is pivotally moved downwardly by the piston 126 to urge the chains 96 and 98 in a rearwardly direction for exerting a required pulling action on the portion of the frame to which they are secured.

In order to prevent the chains 96 and 98 from slipping in the locked pulling position thereof, lock elements 137 and 139 are provided and are in the form of forks, the fingers of which extend around the chains 96 and 98 in the looked position thereof. The lock element 137 is designed to engage the bracket 104, while a bar 141 is secured to the underside of the bracket 141 for receiving the lock element 139 in engagement therewith.

As shown more particularly in FIG. 1, the secondary towers 55 which are also longitudinally and laterally movable on the bed 12 in the manner as described with respect to the primary towers 54, are each formed with a base plate 138 of circular configuration that is slidably and rotatably mounted on the bed 12. Secured to the base and rotatably mounted on the bed 12. Secured to the base plate 138 of each secondary tower 55 are upstanding spaced C-shaped beams 140 and 142, which are fixed to the base plate 138 by a plurality of triangular web plates 144. Secured to beams 140 and 142 of each of the secondary towers 55 in vertical adjustable relation is a hydraulic cylinder 146, and for this purpose a bracket 148 is provided that is mounted on the beams 140 and 142. A set screw (not shown) secures the bracket 148 in a selected vertical position. A piston is movable within the cylinder 146 of each secondary tower 55, and attached to the piston is a plate 150 that is movable into engaging relation with a selected location of the frame to be straightened. In this connection, the hydraulic cylinder 146 urges the plate 150 into either a holding mode or a pushing mode with respect to the frame to be straightened, and cooperates with the primary tower pushing and pulling apparatus for effecting the required straightening operation. Although not shown, it is contemplated that the secondary towers 55 be provided with pulling hooks and for this purpose the hooks could be conveniently secured to the plate 150 of the hydraulic pistons that move within the cylinders 146, or to a chain that would be connected to a hydraulic cylinder.

As further illustrated in FIG. 1, a plurality of conventional frame pinch weld clamps 152 are provided and are longitudinally movable within longitudinally extending slots 154 that are formed in the upper interior frame members 34 and 36, respectively. The pinch weld clamps 152 are of the conventional variety and are secured to a premounted section of a certain type of vehicles for aiding in retaining the frame to be straightened in a fixed position. On occasion it is also desirable to elevate the vehicle above the bed 12, and for this purpose secondary lifts 158 and 160 are provided which are also conveniently hydraulically operated.

In order to demonstrate the manner in which the apparatus of the subject invention is effectively operated to carry out a straightening operation of a vehicle frame, reference is now made to FIGS. 4 through 9, and FIGS. 4*a* through 9*a*. The figures illustrated in FIGS. 4 through 9 are representative examples of the manner in which prior art frame straightening devices are operatively positioned for purposes of carrying out a required frame straightening operation. Corresponding FIGS. 4*a* through 9*a* are examples that illustrate the manner in which the subject invention provides for the location of the primary and secondary towers for effectively carrying out the required frame straightening operation. As will be further described, the set-up time for locating the primary and secondary towers of the subject invention in the appropriate position is substantially less than that required for setting up the various fixing and pulling devices that are normally employed in the prior known frame straightening apparatus.

Figure 4:
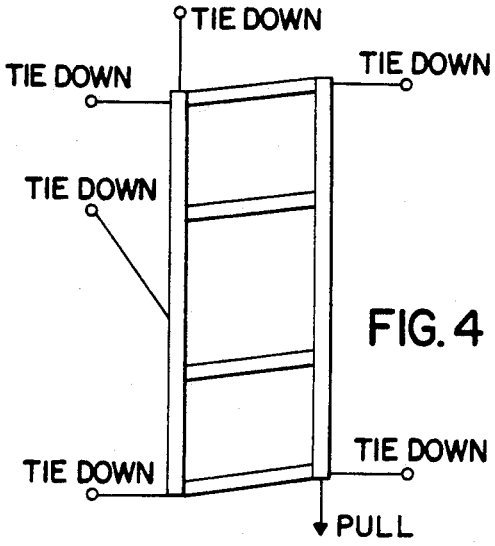
FIGS. 4 through 9 are diagrammatic illustrations of vehicle frames that illustrate various forms of misalignment damage thereto, the prior known techniques that have been utilized for straightening the frames being further illustrated.
Figure 4A:
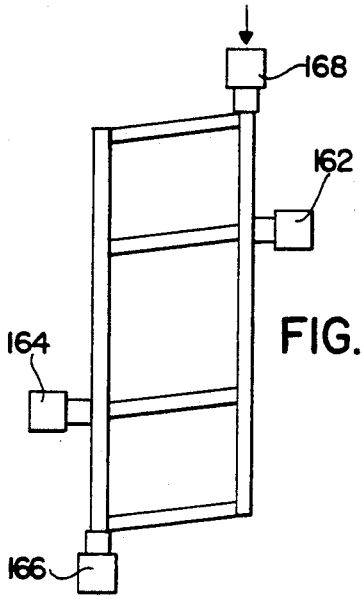

Referring now to FIGS. 4 and 4*a*, a representative example of what is normally referred to as "diamond frame damage" is illustrated. Usually, this kind of frame damage is applicable to full frame vehicles as opposed to a unitized vehicle frame. On a conventional frame straightening machine as illustrated in FIG. 4, the apparatus requires at least five to six tie down or securing points which are indicated in FIG. 4 as those locations in which the frame is preferably tied by chain to a fixed location to secure the vehicle in place. A pulling device would be incorporated in this type of frame straightening operation, and would be pulled from one point, as illustrated. The set-up time for the prior known system as illustrated in FIG. 4 is approximately one to two hours. The repair time is approximately two to three hours.

In straightening diamond frame damage in the use of applicant's apparatus, three predetermined positions are held in place as indicated at locations 162, 164, and 166 in FIG. 4*a*. These hold positions could be accomplished by either utilizing the hydraulic cylinders 70 and 72 of the primary tower, or the hydraulic cylinder 146 of the secondary tower. Thus, the piston plates of the hydraulic cylinders that are placed in engagement with the frame at points 162, 164, and 166 hold the vehicle frame in a fixed position. A pushing action is exerted by the piston in a hydraulic cylinder such as cylinders 70 or 72 of the primary tower, or cylinder 146 of the secondary tower, and is represented at 168 in FIG. 4*a*. As indicated in FIG. 4*a* by the arrow, a pushing action is exerted at the point where the cylinder 168 is located to effect the frame straightening operation. In applicant's apparatus, the set-up time required in the FIG. 4*a* example is 15 to 30 minutes and the repair time required is approximately one-half hour to one hour.

Figure 5:
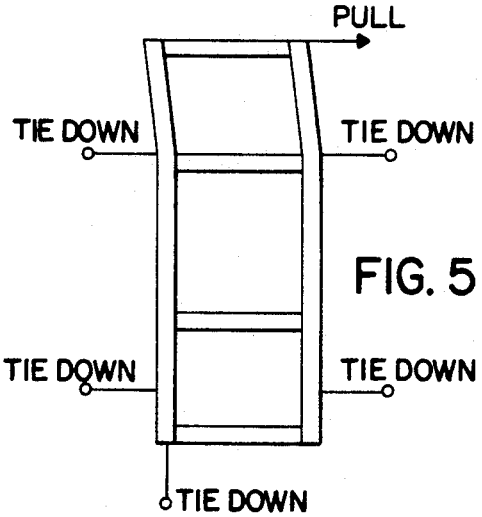
Figure 5A:
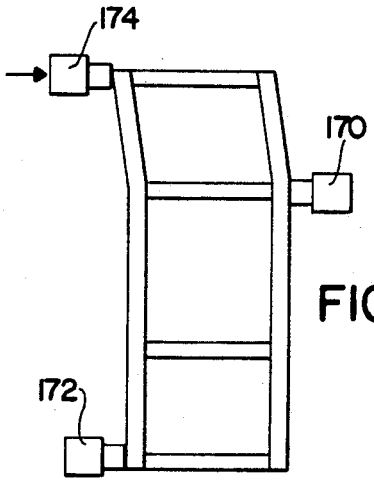

In FIGS. 5 and 5*a*, damage to a vehicle frame is illustrated wherein the front end of the vehicle has been swayed over from a side impact. On a conventional frame straightening machine as shown in FIG. 5, the vehicle frame would require four pinch weld clamps and/or chains to secure the frame in place, as indicated at the sides of the frame on both sides thereof. A further clamp or holding means is also shown in FIG. 5 at the left lower end thereof. The placement of the pinch weld clamps and/or chains in place would require the vehicle to be lifted at both ends. As shown in FIG. 5, the vehicle frame would be pulled from one position as indicated by the arrow for the straightening operation. The set-up time as shown in FIG. 5 is approximately one to two hours and the repair time is one to three hours.

Applicant's apparatus for straightening the frame comparable to the damage as illustrated in FIG. 5 is shown in FIG. 5*a*, and applicant's method requires only two hold positions as indicated at 170 and 172. The hydraulic means in either the primary or the secondary towers could be utilized to effect the hold positions. The frame would be pushed from one position as indicated at 174 and by the arrow, and no pinch weld clamping is necessary. The set-up time required would be ten minutes, and the repair time would be approximately fifteen minutes.

Figure 6:
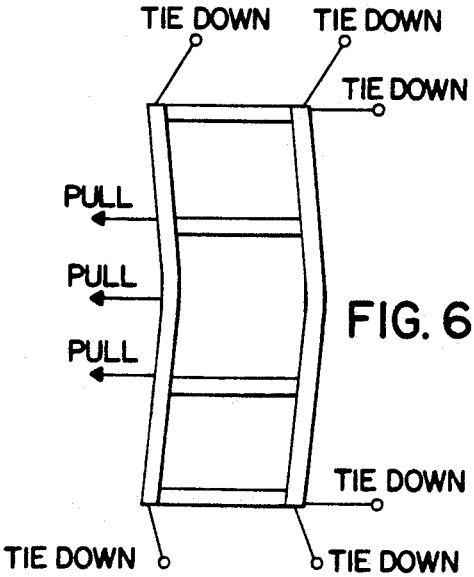
Figure 6A:
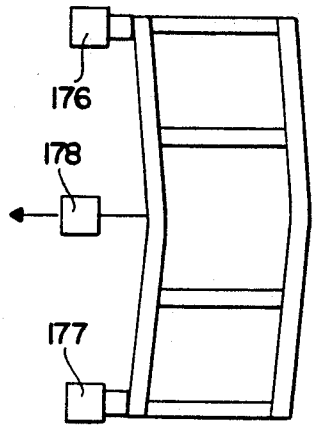

In FIGS. 6 and 6*a*, a side damage to the frame is shown wherein the frame is bowed. On conventional apparatus, securing the frame in place requires six tie-down positions, as indicated. Pinch weld clamps cannot be utilized because the damaged area includes the rocker panel and floor. Utilizing a number of tie downs, as illustrated in FIG. 6, also has the potential to cause further damage to the frame. The frame would necessarily have to be pulled from three side points as indicated in FIG. 6. The set-up time required would be one to two hours. Repair time is approximated at eight to sixteen hours.

In applicant's apparatus, a frame having side damage, as illustrated in 6*a*, would require holding at only two positions, indicated at 176 and 177. These holding positions could also be used as pushing positions, if required, by employing the hydraulic means of the primary and secondary towers. The vehicle would also be pulled by chain from one position indicated by the arrow and at 178. The simultaneous pulling and pushing of the frame as described will effect the proper straightening of the frame. In FIG. 6*a* the set-up time required would be approximately ten minutes, and the repair time would be six to eight hours.

Figure 7:
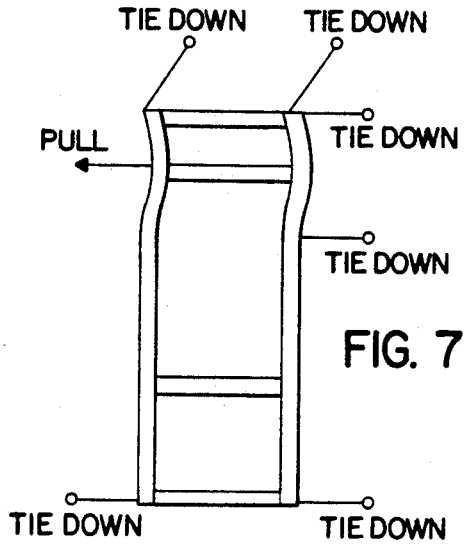
Figure 7A:
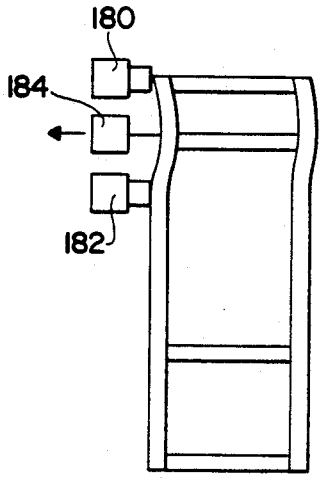

In FIGS. 7 and 7*a*, main front cross-over damage as sustained by the vehicle frame is illustrated. This kind of damage as shown in FIG. 7 is difficult to repair on conventional apparatus, and the frame requires five to six tie-downs with some possibility of causing more damage to the frame. The vehicle is pulled from one point, as indicated by the arrow in the upper left corner of FIG. 7. The set-up time required by the prior known apparatus, as shown in FIG. 7, would be one to three hours, and the repair time would be four to six hours.

In repairing the frame damage show in FIG. 7*a* only two hold positions would be required from the towers in applicant's apparatus to secure the frame for the straightening operation, these positions being indicated at 180 and 182. The frame would also be pulled at one position as indicated by the arrow and at 184, and this position is located between the hold positions so as to effectively carry out the frame straightening operation. The set-up time required in FIG. 7*a* would be ten to fifteen minutes, and the repair time would be approximately one-half hour to one hour.

Figure 8:
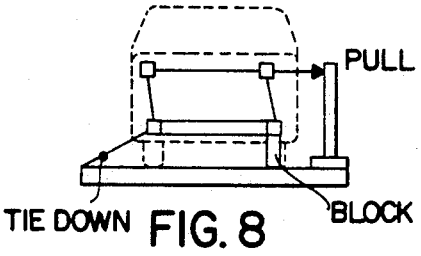
Figure 8A:
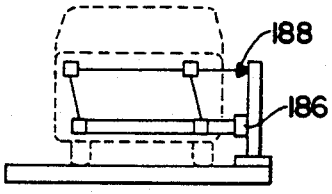

In FIGS. 8 and 8*a*, upper wheelhouse damage is illustrated on a unibody vehicle. On a conventional machine two to four tie-downs would be required, two of which are illustrated in FIG. 8. The vehicle would be pulled from one point. The set-up time for this position is approximately one hour, while the repair time is estimated at two to three hours. In applicant's apparatus as illustrated in FIG. 8*a*, a hold position indicated at 186 is provided, and a single one point pulling location shown at 188 would carry out the frame straightening operation. The set-up time required is ten to fifteen minutes, and the repair time is one-half hour to one hour.

Figure 9:
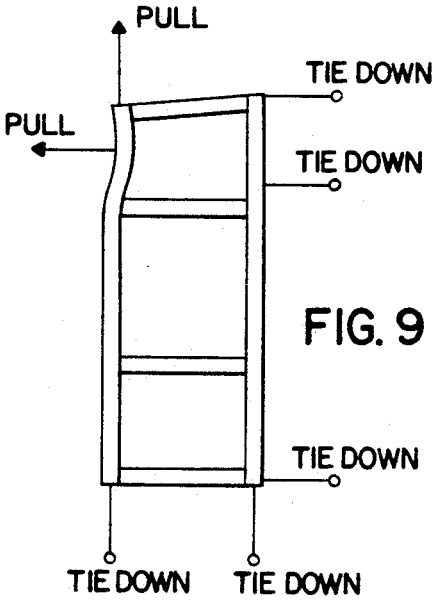
Figure 9A:
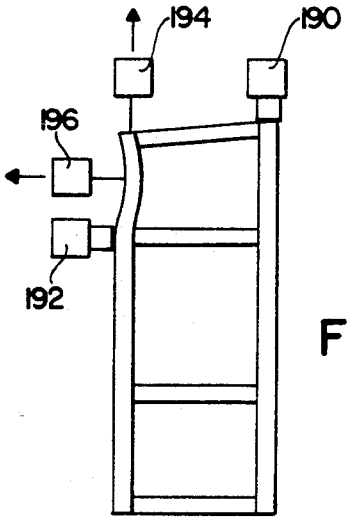

In FIGS. 9 and 9*a*, the example of a frame kinked on one side only is illustrated. In this kind of repair, four to five tie-downs are necessary by the prior known apparatus as shown in FIG. 9, and the frame would be pulled from two points at the upper left corner as indicated. The set-up time required would be one to two hours, and the repair time is estimated at six to eight hours. In applicant's apparatus as shown in FIG. 9*a*, only hold positions 190 and 192 as exerted by the primary or secondary towers are necessary. The frame would be pulled from two points as indicated by the arrows at 194 and 196. The set-up time required would be ten to fifteen minutes, and the repair time is estimated at one to three hours.

It is seen that one of the unique features of applicant's invention, as compared to the prior art frame straightening apparatus, is that applicant's apparatus requires relatively little set-up time. Prior known apparatus requires that the vehicle frame to be straightened must be secured in place by clamps and chains in order to repair the damaged area. This exposes the damaged area to additional damage. Applicant's invention substantially eliminates the tie-down technique effected by clamps and chains in order to repair the damaged area, and instead incorporates the holding devices that effectively retain the frame in the proper position for repair.

It is further seen that the unique construction of applicant's bed avoids the problems of the present apparatus that requires dedicated space to be used because of the low position of the bed, and a requirement that technicians work off the bed and not on the bed. In applicant's construction the bed may be elevated as required, and in addition, the vehicle as mounted on the bed may also be elevated to enable the technicians to work within the bed area.

In applicant's unique construction the ability to push, pull, and hold the frame can be accomplished in a more efficient manner, and in most cases can be limited only to the damaged area of the frame. Further, the undamaged areas of the vehicle and/or the frame are not exposed to damage during the repair of the frame, thereby eliminating unnecessary labor that would be required to repair this additional damage. Thus, the prior known devices which utilize chains or clamps crossing over the undamaged areas and/or being attached to undamaged areas to perform the repairs are not required by the subject invention and thus, undamaged areas of the vehicle and frame are protected.

As stated hereinabove, the low profile bed of the subject invention eliminates the need for a dedicated space, and since the bed of the present invention is designed to be six to ten inches above the floor in the lower position thereof, the technician can perform the work operations while standing on the bed. Movable components can be moved away from the vehicle so as to create a work station for any type of purpose. By incorporating the low profile bed the scissors lift is utilized as described, which will raise the bed from the six inch level to a six foot height above the floor level with the vehicle mounted in place. Thus, all forms of repairs can be accomplished by the technicians without movement of the vehicle to additional locations, or requiring that the technicians crawl under the vehicle for performing the additional repair operations. As also described, the vehicle itself as mounted on the bed can be raised by the secondary scissors lifts. This enhances the efficiency of the apparatus, as well as adding to the flexibility and versatility thereof.

As described hereinabove, the unique concept of providing for the rotating and linear movement of the towers on the bed enables the towers to be disposed in multiple horizontal angular positions so that the hydraulic cylinders and pull chains as mounted thereon can best be positioned for more effectively carrying out the frame straightening operation. The towers are moved along the bed either longitudinally or laterally by the sliding thereof in the slots as formed in the bed, the roller assemblies providing for this purpose The towers are also effectively retained in place on the bed, and because of the disposition of the shaft and circular guide plate as secured to the underside thereof and received in the slots, the shaft and circular guide plate effectively resist the stresses imposed by the loads on the towers during the frame straightening operation to prevent unnatural movement of the towers during the operation. It is seen that the hydraulic cylinders as mounted on the towers are also adjustable in a vertical manner on the beams thereof so as to position the hydraulic cylinders in the most effective location for carrying out the frame straightening operation.

Stability of the subject invention to provide for the pushing, pulling, or holding of the frame by the hydraulic cylinders substantially limits the prior known practice of utilizing multiple tie-downs during the frame straightening operation. Thus, applicant's apparatus can be set up within a relatively short period of time to fix the vehicle frame in place and then provide the pushing or pulling movement as required to effectively straighten the frame. Prior known apparatus do not have the ability of viseing-in of the complete vehicle, such as described herein. The prior known apparatus secures the vehicle in place only through the use of the prior known clamps and chains.

The effective use of the pushing, holding, and pulling cylinders of the subject invention, as incorporated in the towers as described, substantially reduces the set up time for any frame straightening operation and, in addition, substantially decreases the time required for carrying out the frame straightening operation. These effective time savers also result in an economic saving for the user of the apparatus and the owner of the vehicle. The use of the subject invention also substantially prevents the possibility of other damage occurring during the frame straightening operation.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for straightening the frame of a damaged vehicle, comprising a bed on which the damaged vehicle is located during the frame straightening operation, a plurality of first towers mounted on said bed in spaced apart relation and adjustably movable in a horizontal direction relative thereto said towers including a pushing and holding mechanism, at least one of said towers also including a pulling mechanism, said pushing and holding mechanism of said towers including first means for selectively pushing or holding a designated location of the damaged vehicle frame, and said pulling mechanism including second means for being simultaneously selectively operable with the pushing and holding mechanism for pulling a separate designated location of said vehicle frame wherein the frame of said vehicle is effectively straightened, said bed having slots formed therein that are located adjacent to the marginal edges thereof, each of said towers having a guide member that is fixed to the lower end thereof, said guide member being located on the underside of said base plate and being received in a slot for slidably interlocking said tower to said bed.

2. Apparatus as claimed in claim 1, said slots extending longitudinally and laterally of said bed for receiving the guide member of each tower therein in sliding relation, said guide member engaging said bed on the underside thereof adjacent to said slot and cooperating therewith to resist loads applied to said towers during the frame straightening operation.

3. Apparatus for straightening the frame of a damaged vehicle, comprising a bed on which the damaged vehicle is located during the frame straightening operation, a plurality of first towers mounted on said bed in spaced apart relation and adjustably movable in a horizontal direction relative thereto said towers including a pushing and holding mechanism, at least one of said towers also including a pulling mechanism, said pushing and holding mechanism of said towers including first means for selectively pushing or holding a designated location of the damaged vehicle frame, and said pulling mechanism including second means for being simultaneously selectively operable with the pushing and holding mechanism for pulling a separate designated location of said vehicle frame wherein the frame of said vehicle is effectively straightened, each of said towers being mounted on said bed for rotary movement so as to provide for multiple horizontal angular positions of the pushing, pulling, and holding mechanisms as incorporated on said towers, each of said towers including a base plate that is mounted on said bed for slidable longitudinal and rotary movement relative thereto, and means for securing said base plate to said bed in a selected adjusted position thereon, roller members secured to the underside of said base plate and engaging said bed, said roller members providing for easy sliding movement of said towers relative to said bed in the adjustable movement thereof, said bed having longitudinally and laterally extending "T" shaped slots formed therein, a shaft secured to the underside of the base plate of each tower and a circular guide plate secured to said shaft, said shaft and circular guide plate being received in said "T" shaped slot for locating said towers in an adjusted position on said bed for resisting loads applied to said towers in the frame straightening operation.

* * * * *